United States Patent [19]

Hirtle et al.

[11] 4,060,930

[45] Dec. 6, 1977

[54] TOY AIRPLANE LAUNCHER

[75] Inventors: Michael O'Hara Hirtle, Torrance; James Edward Morse, Lawndale, both of Calif.

[73] Assignee: Mattel, Inc., Hawthorne, Calif.

[21] Appl. No.: 727,885

[22] Filed: Sept. 29, 1976

[51] Int. Cl.[2] ..... A63H 27/04

[52] U.S. Cl. ..... 46/81

[58] Field of Search ..... 46/81; 124/17

[56] References Cited

U.S. PATENT DOCUMENTS

| | | | |
|---|---|---|---|
| 1,375,971 | 4/1921 | Parrish | 46/81 |
| 1,382,009 | 7/1921 | Nemethy | 46/81 |
| 1,644,362 | 10/1927 | Wilson | 46/81 |
| 1,887,337 | 11/1932 | Spotz | 46/81 |
| 2,009,858 | 7/1935 | Riopelle | 124/21 |
| 2,408,984 | 10/1946 | Lawson | 124/17 |
| 2,426,437 | 8/1947 | Cole et al. | 46/81 |
| 2,663,291 | 12/1953 | Hall | 124/17 |
| 2,708,431 | 5/1955 | Walker | 124/22 |
| 3,031,797 | 5/1962 | Gelfand | 46/81 |
| 3,068,612 | 12/1962 | Simpson | 46/81 |
| 3,496,671 | 2/1970 | Korona | 46/81 |
| 3,902,271 | 9/1975 | Turoff | 46/81 |

*Primary Examiner*—Louis G. Mancene
*Assistant Examiner*—Robert F. Cutting
*Attorney, Agent, or Firm*—John G. Mesaros; Max E. Shirk; Stephen King

[57] ABSTRACT

A toy airplane launcher having a launch platform adapted for supporting two toy airplanes, each of the airplanes having a rubber band engaging portion and a depending projection for abutting against an airplane engaging post positioned adjacent the surface of the launcher. A single trigger is provided for displacing the post relative to the platform for disengaging the airplane to permit it to be launched under the force of the rubber band. The platform, post, and trigger are so constructed to permit the sequential launching of the airplanes upon slow movement of the trigger and to provide virtually simultaneous launching upon rapid actuation of the trigger. In a first embodiment the airplanes are positioned along generally parallel runways with the airplane engaging posts for each airplane being offset from one another, the posts disengaging from the airplane as they move along a line perpendicular to the plane of the platform. In a second embodiment the airplanes are mounted in tandem on the platform and a launch platform is provided with ramp means adjacent the airplane projection, the lead ramp being closer than the rear ramp so that as the posts are moved in a direction parallel to the plane of the platform the depending projections on the plane are lifted from the post with the lead ramp disengaging its post first.

14 Claims, 9 Drawing Figures

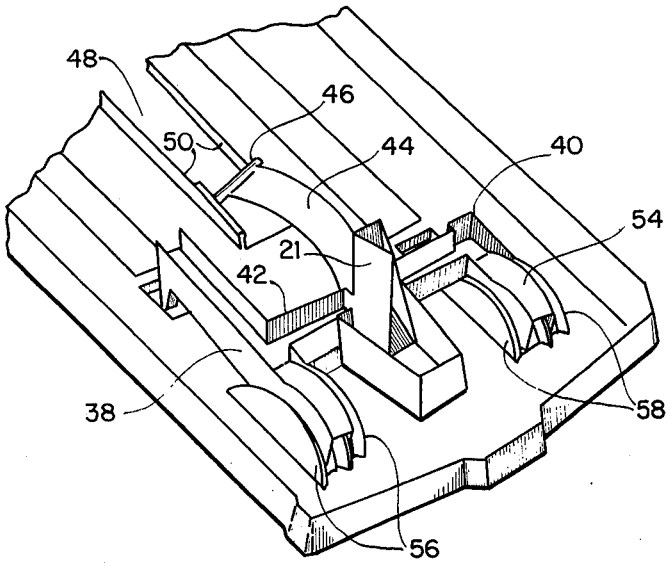
FIG. 6
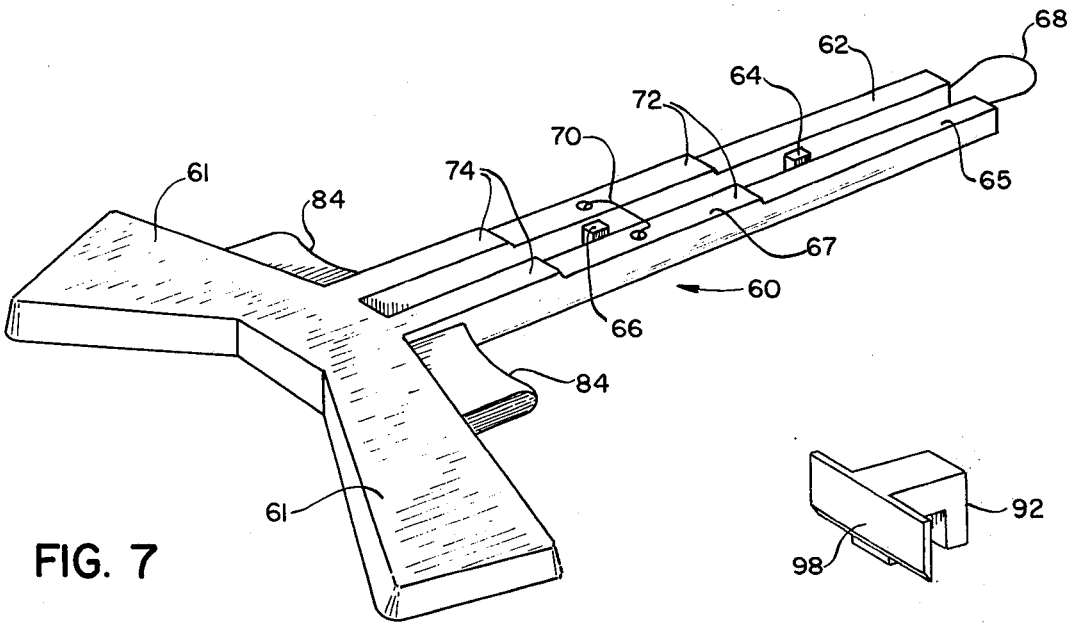
FIG. 7
FIG. 9
FIG. 8
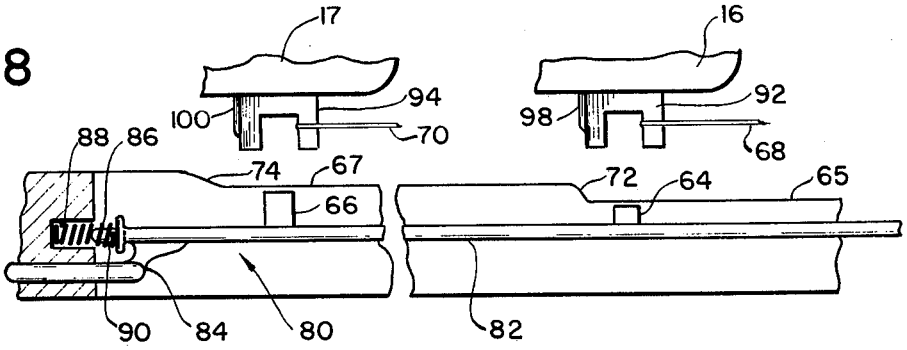

TOY AIRPLANE LAUNCHER

BACKGROUND OF THE INVENTION

The background of the invention will be set forth in two parts.

FIELD OF THE INVENTION

The present invention pertains generally to the field of toys and more particularly to a toy airplane launcher for launching two or more airplanes under the operation of a single trigger, the launcher being so constructed that the airplanes can be launched in sequence or virtually simultaneously under the control of a single trigger.

DESCRIPTION OF THE PRIOR ART

Launching devices for a single toy airplane are numerous in the prior art. For devices being able to launch two or more airplanes U.S. Pat. Nos. 2,261,512 and 3,902,271 show two specific types of devices capable of launching two or more toy airplanes. The first of the two references discloses a toy simulating an airplane carrier mounted on wheels, the toy being propelled by a spring-wound motor. As the toy moves under control of its motor, the motor operates cam members, one for each flight station to successively launch the airplanes.

In the latter reference, the airplanes are constructed with tubular members engaging rods on a hand-held launcher, the planes being released to operate under the force of coil springs upon actuation of a trigger.

Other prior art known to the applicant is listed by way of illustration, but not of limitation, in separate communications to U.S. Patent Office.

The present invention exemplifies improvements over this prior art.

SUMMARY OF THE INVENTION

It is the primary object of the present invention to provide a new and improved toy airplane launcher.

It is another object of the invention to provide a new and improved toy airplane launcher having one trigger for launching two or more airplanes sequentially upon slow movement of the trigger and virtually simultaneously upon rapid actuation of the trigger.

According to the present invention, the toy airplane launcher is provided with a launch platform having elastic band launching means positioned for coacting with each of the airplanes to be mounted thereon. Each of the airplanes is provided with means at the front end thereof for engaging the band and a depending projection rearwardly thereof for engaging a post in the platform with the band stretched and the airplane in its pre-launch condition. Both posts are movable under the operation of a single trigger, the posts and platform in proximity to the posts being so configured that upon actuation of the trigger, slowly, one airplane is launched prior to the other by means of the posts being displaced relative to the depending projection on the airplane to permit it to leave the platform under operation of the elastic band.

In a first embodiment the airplanes are positioned on the platform on parallel runways with one post being set forwardly of the other in the direction of flight of the airplanes, the posts being displaced along a line generally perpendicular to the plane of the platform so that the lead plane is launched first.

In the second embodiment the planes are mounted on the platform in tandem and ramp means are provided on the platform in proximity to the airplane projections. The lead post is shorter in height than the rearward post and upon actuation of the trigger both posts travel simultaneously rearwardly until the ramp means engage the projections on the airplane to thereby lift the lead airplane first by virtue of a shorter post and the second airplane thereafter. In both embodiments the speed of actuation of the trigger determines the time differential between successive launchings so that upon rapid actuation of the trigger virtually simultaneous launching is effected.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings in which like reference characters refer to like elements in the several views.

BRIEF DESCRIPTION OF THE DRAWINGS

FIG. 6 is a partial perspective bottom view of the launching platform of FIG. 1 showing the trigger assembly details;

FIG. 7 is a perspective view of a second embodiment of a toy airplane launcher for tandem mounting of toy airplanes;

FIG. 8 is a partial cross sectional view of the launching platform of FIG. 7 taken along the longitudinal axis thereof with portions of airplanes ready for loading; and FIG. 9 is a partial view of the projection on the underside of the toy airplane of FIG. 7.

DESCRIPTION OF THE PREFERRED EMBODIMENT

Figure 1:
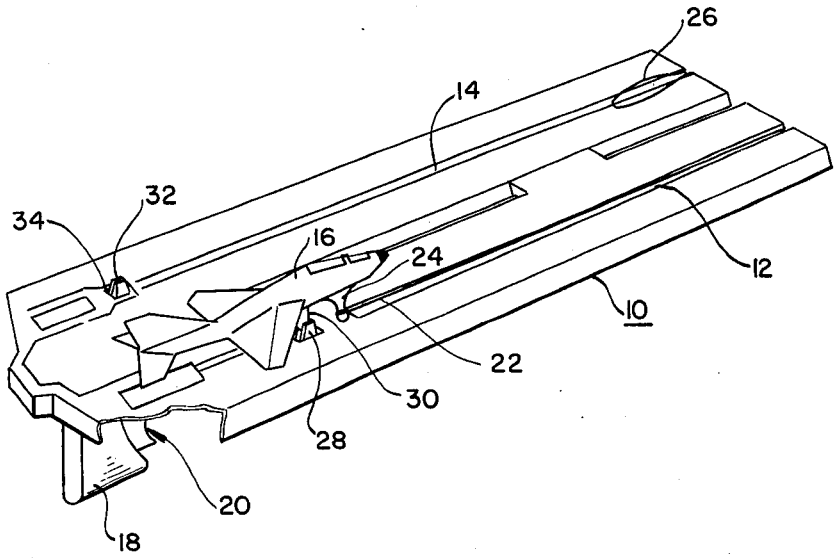
FIG. 1 is a perspective view (partially broken away) showing a first embodiment of a toy airplane launcher according to the invention with one airplane being shown in the launch position.

Referring now to the drawings and more particularly to FIG. 1 there is shown a toy airplane launcher having a launch platform 10 having a generally planar upper surface suitably designed to provide a pair of parallel "runways" designated 12 and 14, runway 12 having positioned through a toy airplane 16 in its energized pre-launch position. Depending down from the under surface of the platform 10, at the rearward end thereof is a pistol grip handle 18 secured to the platform 10 and a slidable or movable trigger assembly 20 coacting therewith.

Associated with each of the runways 12 and 14 is an elastic band, the elastic band 22 of runway 12 being shown as stretched and engaging a simulated nose wheel 24 of the airplane 16. The elastic band 26 associated with runway 14 is shown in its unstretched condition.

At the rearward end of each of the runways there is an airplane engaging post, the post 28 associated with runway 12 extending through aperture 29 in platform 10 and being shown engaging a downwardly depending projection 30 secured to or integral with the under belly of the airplane 16. A second post 32 extends upwardly through an aperture 34 in the platform 10. As can be seen in FIG. 1, the post 28 associated with runway 12 is positioned forwardly (in the flight direction of the airplane 16) to the post 32, and as will be discussed hereinafter the posts 28 and 32 are simultaneously actuated by the trigger 21 to provide sequential launching of the airplane 16 and a second airplane coacting with the post 32 on runway 14.

Figure 2:
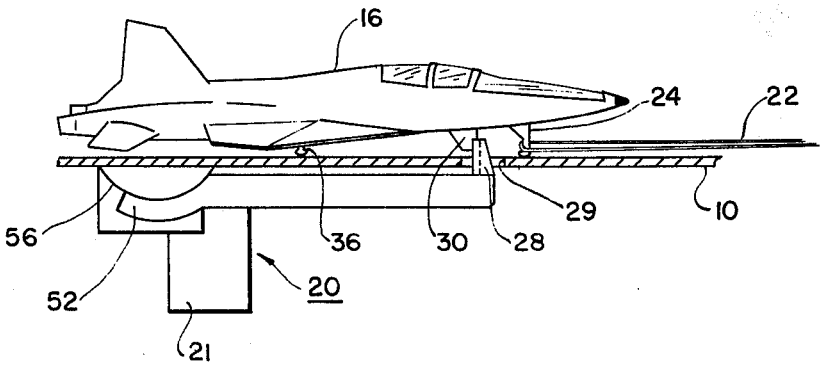
FIG. 2 is a partial sectional view of the launcher of FIG. 1 taken along the line of flight of the airplane depicted in FIG. 1.

Referring now to FIG. 2 the details of securing the airplane 16 will be discussed in detail (FIG. 2 as well as 3 through 6 have the pistol grip handle 18 removed for clarity). The airplane 16 is generally configured to resemble a jet fighter plane with a nose wheel 24 and a pair of main wheels 36 (only one of which is shown) depending from beneath the wing portion. Intermediate the nose wheel 24 and the rear wheels 36 is a downwardly depending fin-shaped projection 30 having the forward end thereof adapted for engaging a recess (shown in dotted lines) in the rearward edge of the post 28 when the airplane 16 is positioned on the platform 10 with the elastic band 22 in its stretched position about nose wheel 24.

The trigger assembly 20 includes trigger 21 and posts 28 and 30 formed in one piece, having the trigger 21 disposed in a direction generally perpendicular to the plane of the platform 10 with a pair of arms 38 and 40 (see also FIG. 6) extending generally perpendicular to the trigger 21 with the posts 28 and 32, respectively, extending perpendicularly upward from the arms at the free ends thereof.

As better illustrated in FIG. 6, the trigger assembly 20 is generally H-shaped with the trigger 21 being connected to the cross-portion 42, the trigger 21 being disposed rearwardly at the central portion thereof. Extending forwardly of the trigger member 21 is a trigger bias strap member 44 which is provided with a transversely-extending guide rod 46 formed in the end thereof. A channel 48 is formed in the under surface of the launch platform 10, the channel 48 having a pair of inwardly disposed siderails 50 configured for engagement with rod 46 to permit sliding movement thereof.

The H-shaped trigger member 20 has long arm 38 and short arm 40 thereof extending in the forward direction from cross member 42. A second pair of arms 52 and 54 extend rearwardly of cross member 42 in alignment with arms 38 and 40 respectively, the arms 52 and 54 each having an arcuate shaped portion for matingly engaging two pairs of pivot projections 56 and 58.

The pivot projections 56 are formed integrally with the under surface of the platform 10 and are arcuately shaped extending perpendicular to the plane of the platform with the opposite sides thereof being in spaced parallel relation and having the inner surfaces configured to matingly engage the arm segment 52 to provide pivotal movement of the trigger assembly 20 about an axis rearwardly of the trigger 21 against the force of trigger bias strap member 44 which is slidably retained within channel siderails 50 by means of guide rod 46.

Figure 3:
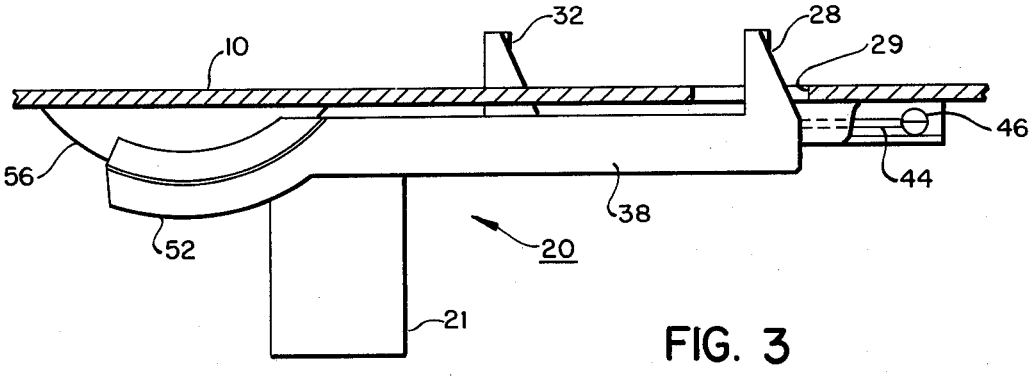
FIGS. 3, 4 and 5 are cross sectional views of the platform showing sequential operation of the trigger to permit successive launching of airplanes on parallel runways such as depicted in FIG. 1.
Figure 4:
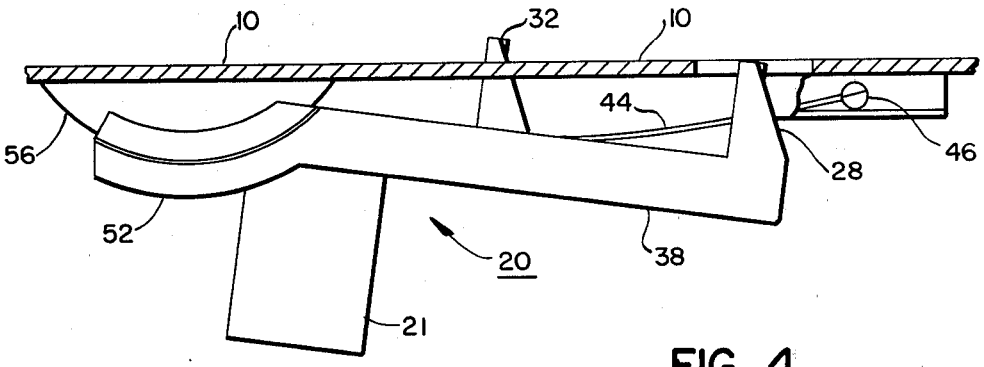
Figure 5:
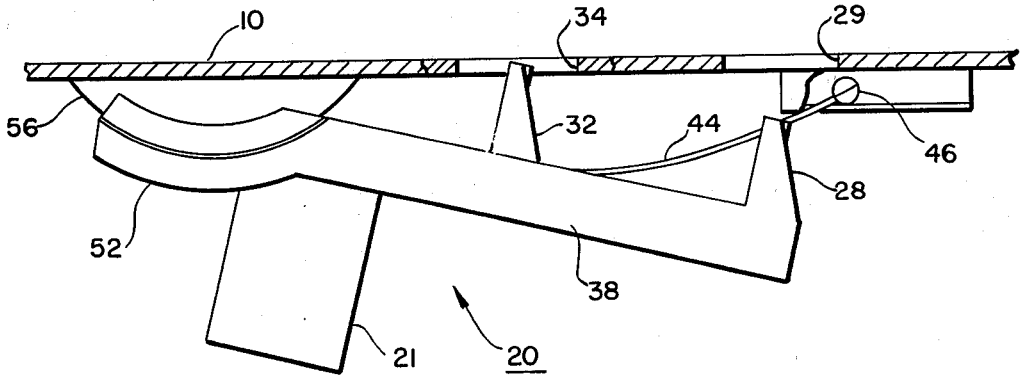

The sequence of operation is illustrated in FIGS. 3, 4 and 5 (without an airplane) and as can be seen, the trigger assembly 20 has the arcuate segmented arm 52 thereof rotating about pivot projection 56 with arm 38 effectively acting as a lever arm longer than lever arm 40.

As shown in FIG. 4, as trigger 21 is rotated in a clockwise direction, as viewed, the post 28 at the end of the lever arm 38 is displaced relative to platform 10 a greater distance for a given angle than post 32 so that the upper edge of post 28 is flush with the upper surface of launch platform 10 to thereby completely release a toy airplane engaged thereby. At that point, post 32, having a shorter lever arm 40, is still above the surface of launch platform 10 and the engagement of post 32 with a downwardly depending projection of an airplane will still be effected.

As the trigger 21 is rotated further clockwise, as shown in FIG. 5, the rearward post 32 will then be flush with or below the surface of the launch platform 10 thereby effecting release of a second airplane retained thereby. Effectively, the configuration of trigger assembly 20 provides a mechanical phase displacement between post 28 and post 32 which is translated to a time differential launching, with the duration of the time differential decreasing in accordance with the speed with which the trigger 21 is pulled, or, in other words, the time differential is inverse to the speed of rotation of the lever arms.

By means of the construction shown in the first embodiment, a relative displacement occurs between the launch posts and the downwardly depending projections on the airplanes. Depending on the speed of the displacement, the airplanes appear to be launched simultaneously with rapid actuation of the trigger.

Referring now to FIGS. 7, 8 and 9, a second embodiment is illustrated wherein a launch platform 60 has integral therewith a transversely extending handle portion 61 adapted for gripping by an operator utilizing either one or both hands. Longitudinally disposed within the launch platform 60 is a central channel 62, and slidably positioned therein is a pair of launch posts 64 and 66, for simultaneous movement, each of the launch posts cooperating with an adjacent launch area 65 and 67 respectively. As shown in FIG. 8, the launch platform areas 65 and 67 are parallel planes formed in launch platform 68 with the area 67, that area closer to the rearward end of launch platform 60, being elevated with respect to the forward or lead, launch area 65. Correspondingly the lead post 64 is shorter in height than the rearward post 66 to compensate for the difference in elevation of two launch platform areas.

As shown in FIG. 7, in this particular configuration, the lead post 64 which is positioned forwardly in the direction of intended flight of the airplane, has a first elastic band 68 which provides the propulsion power for an airplane to be mounted thereon. Positioned rearwardly along the same axis is the second post 66 which has a second elastic band 70 associated therewith, the platform 60 being so constructed that the airplanes, when mounted thereon, would be in tandem, that is, one behind the other. Formed in the upper surface of the launch platform 60, in proximity to each of the posts 64 and 66, are ramp means 72 adjacent the rearward end of launch platform area 65 and ramp means 74 at the rearward end of launch platform area 67.

The operation of the launcher of FIG. 7 will be discussed by reference to FIG. 8 which shows portions of airplanes 16 and 17 just prior to engagement with the respective posts 64 and 66 of the tandem toy airplane launcher. The trigger assembly 80 has a longitudinally extending body member 82 disposed for slidable engagement within channel 62, the body member 82 being, for example, rod shaped or bar shaped and having post 64 and 66 formed integral therewith or attached thereto. At the rearwardly end of the body member 82, and integral therewith, there is provided a pair of triggers 84 adapted for slidable engagement within handle 61 to thereby permit manual actuation by either or both hands or an operator. The body member 82 is normally biased in a forward direction by means of a coil spring 86 engaging a recess 88 within the housing of the handle 61, the other end thereof encircling a rearward projection 90 of the body member 82. Although not shown, it is to be understood that the body member 82 has provided with suitable guide means for supporting it within the channel 62 to permit sliding movement thereof in a plane parallel to the plane of each of the launch platform areas 65 and 67.

Depending downwardly from each airplane 16 and 17 (only partially shown) are the downwardly depending projections 92 and 94, each of which is shown engaging its respective elastic band 68 and 70. The projections 92 and 94 are suitably slotted to engage posts 64 and 66 respectively. Extending generally transverse to and connected to, projections 92 and 94 are suitable guide members 98 and 100 having the lower edges thereof rounded or tapered. As shown in FIG. 9 guide member 98 (and similarly guide member 100) is configured to bridge the channel 62 to slide along launch platform area 65.

In operation, although projections 92 and 94 are shown as being displaced from the respective posts 64 and 66, it is to be understood that they are mounted, under tension of the elastic band 68 and 70, on the respective posts with guide members 98 and 100 abutting launch areas 65 and 67 respectively. As the trigger 84 is operated rearwardly, posts 64 and 66 move simultaneously rearwardly, carrying along with them, projections 92 and 94 of airplanes 16 and 17 respectively. As airplane 16 moves rearwardly, the tapered edge of guide member 98 engages the ramp surface 72 to thereby lift the airplane 16 in a vertical direction until the lower edge of projection 92 is released from lead post 64. At the instance of release of airplane 16 the airplane 17 is still being carried rearwardly by means of post 66 engaging projection 94 until such time as member 100 is moved an additional distance until the tapered portion thereof coacts with ramp means 74 and the lower edge of projection 94 clears post 66. As can be seen in FIG. 8, the distance between ramp 74 and post 66 is greater than the distance between ramp 72 and its associated post 64 to provide a mechanical phase displacement. Consequently, if trigger 84 is depressed slowly an operator can launch airplane 16 without launching airplane 17. An additional increment of travel of trigger 84 will result in the release of airplane 17.

With either of the embodiments shown the operator has the choice of launching the lead airplane first without launching the second airplane until some subsequent time, or he can launch both airplanes sequentially with the time differential between launchings being dependent upon the speed of trigger actuation.

While there has been shown and described a preferred and alternate embodiment it is to be understood that various other adaptations and modifications may be made within the spirit and scope of the invention.

What is claimed is:

1. In a toy airplane launcher, the combination comprising:

a plurality of toy airplanes, each of said airplanes having a downwardly depending projection;

a launch platform adapted for supporting said airplanes;

resilient propoulsion means on said platform adapted for releasable engagement with each of said airplanes;

a trigger assembly movably mounted on said platform and having integral therewith a plurality of posts, each of said posts being offset from any other and being adapted for engaging said projection on said airplane to restrain the so-engaged airplane against the force of said resilient means; and means operative on movement of said trigger assembly to displace each of said projections relative to its engaged post, the post and platform being so configured to provide individual launching of each of said airplanes with a time differential between launchings, said time differential being inversely proportional to the speed of movement of said trigger assembly.

2. The combination according to claim 1 wherein each of said posts are positioned along a given line indicative of the intended flight path for supporting said airplanes on said platform in tandem relationship.

3. The combination according to claim 2 wherein each of said posts are affixed to a common member coupled to a trigger of the trigger assembly.

4. The combination according to claim 3 wherein said launch platform is provided with ramp means rearwardly of each of said posts, in the direction of the intended line of flight, and each of said projections on said airplanes is provided with guide means for abutting against said ramp means upon actuation of said trigger.

5. The combination according to claim 4 wherein the distance between each of said ramp means and its associated post decreased in the direction of the intended line of flight.

6. The combination according to claim 5 wherein said launch platform has discrete launching areas in planes parallel to the plane of movement of said common member, the distance between the plane of each launch area and said common member decreasing in the direction of the intended line of flight.

7. The combination according to claim 6 wherein said resilient propulsion means includes an elastic band secured to said platform forwardly of each of said posts for engaging a portion of each of said airplanes.

8. The combination according to claim 6 wherein the height of each post is progressively shorter in the direction of the intended line of flight.

9. The combination according to claim 1 wherein said platform is so configured and said posts are so positioned with respect to said platform to provide a line of flight for each airplane parallel to a line of flight for an adjacent airplane, said posts being offset with respect to one another along the intended line of flight.

10. The combination according to claim 9 wherein each of said posts is integral with an arm and each of said arms is coupled to the trigger of said trigger assembly.

11. The combination according to claim 9 wherein said trigger assembly is mounted for pivotal movement with the pivot point rearwardly of said trigger.

12. The combination according to claim 11 wherein upon actuation of said trigger each of said posts displaced in a direction generally perpendicular to the plane of the platform and the sequence of release of each of said airplanes is determined by the length of the arm associated with its respective post.

13. The combination according to claim 12 wherein said trigger assembly is provided with biasing means urging against the movement of said trigger.

14. The combination according to claim 13 wherein said bias means include a flexible strap member integral with said trigger assembly, said strap member slidably engaging a channel formed in the under surface of said launch platform.

* * * * *